US009730535B2

(12) United States Patent
Martin

(10) Patent No.: US 9,730,535 B2
(45) Date of Patent: Aug. 15, 2017

(54) LAYERED AND SECUREABLE SPARE FLAPS FOR REST SUPPORTS

(76) Inventor: Brent Thomas Martin, Plano, TX (US)

( * ) Notice: Subject to any disclaimer, the term of this patent is extended or adjusted under 35 U.S.C. 154(b) by 0 days.

(21) Appl. No.: 13/352,576

(22) Filed: Jan. 18, 2012

(65) Prior Publication Data

US 2012/0186016 A1 Jul. 26, 2012

Related U.S. Application Data

(60) Provisional application No. 61/461,621, filed on Jan. 21, 2011.

(51) Int. Cl.

| | |
|---|---|
| ***A47G 9/00*** | (2006.01) |
| ***A47G 9/02*** | (2006.01) |
| ***A47G 9/10*** | (2006.01) |
| ***A47C 31/11*** | (2006.01) |

(52) U.S. Cl.

CPC ..... *A47G 9/0253* (2013.01); *A47C 31/11* (2013.01); *A47G 9/007* (2013.01); *A47G 2009/004* (2013.01)

(58) Field of Classification Search

CPC ... A47G 9/00; A47G 9/10; A47G 9/02; A47G 9/0253; A47G 2009/004

USPC ..... 5/487, 488, 489, 490, 636, 922, 923

See application file for complete search history.

(56) References Cited

U.S. PATENT DOCUMENTS

| | | | | |
|---|---|---|---|---|
| 1,380,480 | A * | 6/1921 | Jennings | 5/490 |
| 1,942,287 | A * | 1/1934 | Heitz | 206/447 |
| 3,044,517 | A * | 7/1962 | Levi | 150/158 |
| 3,761,973 | A * | 10/1973 | Leventhal | 5/484 |
| 3,974,531 | A * | 8/1976 | Van Pelt | 5/490 |
| 4,651,371 | A * | 3/1987 | Hahn | 5/497 |
| 5,430,902 | A * | 7/1995 | Lewis | 5/490 |
| 5,557,815 | A * | 9/1996 | Mintz et al. | 5/636 |
| 5,572,753 | A * | 11/1996 | Ruscitto | 5/490 |
| 5,991,945 | A | 11/1999 | Pang | |
| 6,175,978 | B1 * | 1/2001 | Nizzi et al. | 5/644 |
| 6,209,156 | B1 | 4/2001 | Hershey | |
| 6,928,675 | B2 | 8/2005 | Hamilton | |
| D509,695 | S * | 9/2005 | Cuttino | D6/601 |
| 7,013,509 | B2 * | 3/2006 | Hickman | 5/485 |
| 2005/0150048 | A1 | 7/2005 | Hamilton | |
| 2008/0289104 | A1 * | 11/2008 | Rowson et al. | 5/482 |

* cited by examiner

*Primary Examiner* — Nicholas Polito
*Assistant Examiner* — Ifeolu Adeboyejo
(74) *Attorney, Agent, or Firm* — Law Office of Jeff Williams; J. Oliver Williams

(57) ABSTRACT

A cover for rest supports such as pillow cases, seat cushions, headrests, armrests, bedding and pet bedding is disclosed with layered secure spare flaps. A plurality of spare flaps are attached in respective layers to the cover at an end of each flap and another end is successively folded around the cover and secured thereto to provide additional unused resting surfaces for a person or an animal. The spare flaps therefore provide multiple fresh resting surfaces between launderings. Embodied flaps may also be disposably detached from the cover to preclude launderings altogether. The layered flaps may include use indicia and be to secured to each other and a rest support cover via a fastener on a flap and a complementary fastener disposed respectively on the cover. Disclosed fasteners include thin magnets, hook and loop, grommet and tie, button and hole and ganged hole and post pairs and the like.

10 Claims, 8 Drawing Sheets

LAYERED AND SECUREABLE SPARE FLAPS FOR REST SUPPORTS

CROSS-REFERENCE TO RELATED APPLICATION

This application claims the benefit of the priority date of earlier filed U.S. Provisional Patent Application Ser. No. 61/461,621, filed Jan. 21, 2011 titled, Pillow Case with Flaps, incorporated herein by reference in its entirety.

BACKGROUND OF THE INVENTION

Pillow cases help keep an underlying pillow clean and allow a user to launder the case rather than the pillow itself and therefore extend the useful life of the pillow. However, some users require frequent pillow case changes due to illness, sores, and allergies to dander etc. Frequent changing of a pillow case may maintain a hygienic or sanitary sleeping surface but requires high maintenance. In their conventional form, pillow cases have only two sides which may be soiled or otherwise contaminated after only two nights of use.

A pillow case may be ideally laundered every two days to maintain a healthy sleeping environment but this is not usually the case. Usually, pillow cases go without being laundered for many days and even weeks, allowing sweat, saliva, dirt, natural oils, dandruff, hair, and make up to accumulate thereon. The ideal situation is to have a pillow case that provides a clean sleeping surface to the user every single night without the maintenance hassle of daily laundry or daily changings.

Additionally, medical patients and otherwise ill people may recover from sickness faster avoiding exposure to germs that they would be exposed to when a pillow case does not get frequently changed. Those who drool in their sleep or tend to forget to remove their makeup may also benefit from a fresh pillow case. Others who do not wash their sheets or pillowcases often enough will also benefit including college students, travelers and those who do not own a washer and dryer or otherwise have means to get to a Laundromat.

Therefore, a market and a long felt need exist for a clean sleeping surface each and every night without daily laundering or daily changings. Fresh sleeping surfaces accordingly provide a multitude of benefits for different users with differing circumstances. Acne sufferers would no longer be sleeping on a case that has been absorbing acne exudates for days or weeks. Allergy sufferers may be able to avoid inhaling hair, dust, dead skin (dandruff), etc. with a fresh sleeping surface. College students, travelers and others with no or limited access to laundering facilities may also benefit.

SUMMARY OF THE INVENTION

A cover for rest supports such as pillow cases, seat cushions, headrests, armrests, footrests, bedding and even pet bedding is disclosed with layered and securable spare flaps. The cover is configured to enclose at least a portion of a rest support. The cover has a top and a bottom resting surface and a seam there between. A plurality of spare flaps is attached in respective layers to the cover at the seam thereof and at one end or more of each flap. A distal end of each flap is successively wrapped or folded around the cover and secured thereto to provide additional unused resting surfaces for a person or an animal. The spare flaps therefore provide multiple fresh resting surfaces between changings and launderings. Embodied flaps may also be disposably detached from the cover to preclude launderings altogether. The layered flaps may include use indicia to assist a user in keeping track of which surfaces have been used. The layered flaps are securable to each other and the rest support cover itself via a fastener on a flap and a complementary fastener disposed respectively on the cover. Disclosed fasteners include thin magnets, hook and loop, grommet and tie, button and button hole pairs and ganged hole and post fasteners and the like.

A pillow case, as a rest support cover, is disclosed comprising a plurality of spare flaps attached in respective layers to an outside of the pillow case at an end of each flap. A free end of each flap is configured to successively fold or wrap around the pillow case and provide an additional unused surface. At least one fastener is disposed at a flap free end distally positioned from the attached end, the fastener configured to secure the flap free end to at least one of the pillow case and another flap.

A head rest cover is also disclosed comprising a plurality of spare flaps attached in respective layers to the headrest at an end of each flap. Each flap is configured to successively fold or wrap around the head rest and provide at least one additional unused resting surface. At least one of the headrest cover spare flaps are attached to the headrest via one of an adhesive, a sewed seam, a perforation, a zipper, a magnet, a hook and loop complementary pair, etc.

Other aspects and advantages of embodiments of the disclosure will become apparent from the following detailed description, taken in conjunction with the accompanying drawings, illustrated by way of example of the principles of the disclosure.

FIG. **6*a*** is a side elevational view of a mechanical fastener for securing multiple spare flaps via complementary stacked magnets in accordance with an embodiment of the present disclosure.

FIG. **6*b*** is a side elevational view of a post and ganged hole mechanical fastener for securing multiple spare flaps to a pillow case in accordance with an embodiment of the present disclosure.

Figure 7:
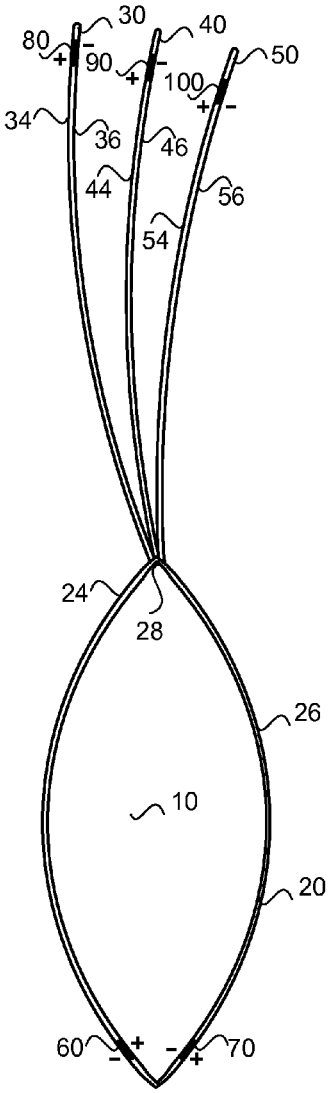

FIG. 7 is a side elevational view of a pillow case with layered and securable spare flaps extending from the pillow in accordance with an embodiment of the present disclosure.

Figure 8:
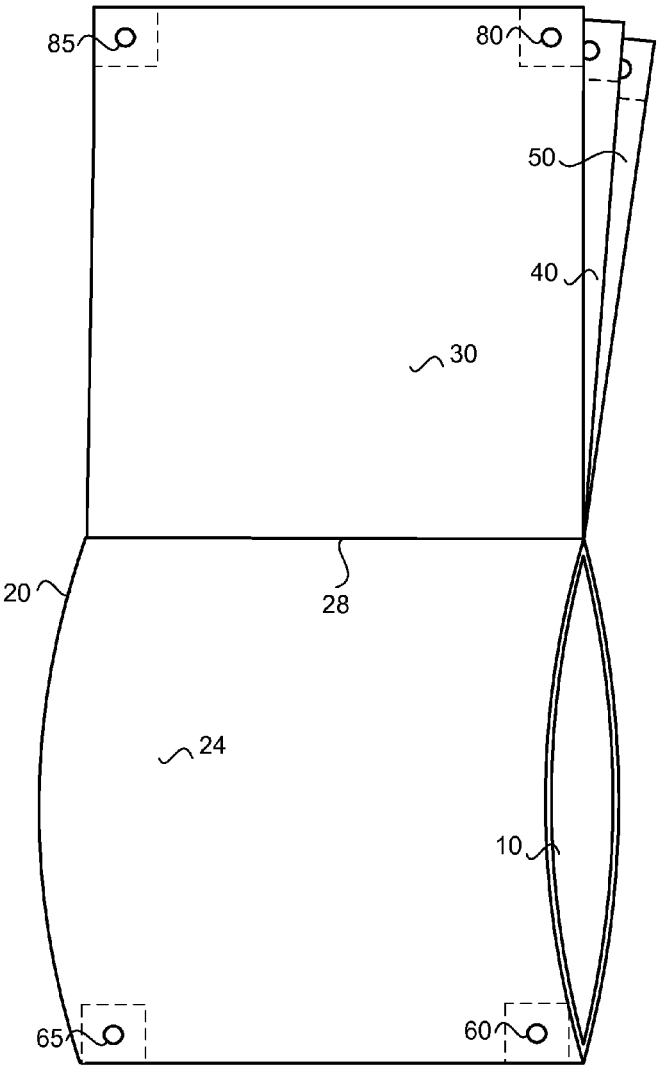

FIG. 8 is a top perspective view of a pillow case with layered and securable spare flaps extending from the pillow in accordance with an embodiment of the present disclosure.

Figure 9:
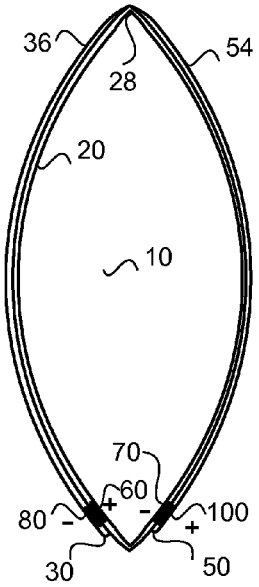

FIG. 9 is a side elevational view of a pillow case with layered and securable spare flaps folded around the pillow in accordance with an embodiment of the present disclosure.

Figure 10:
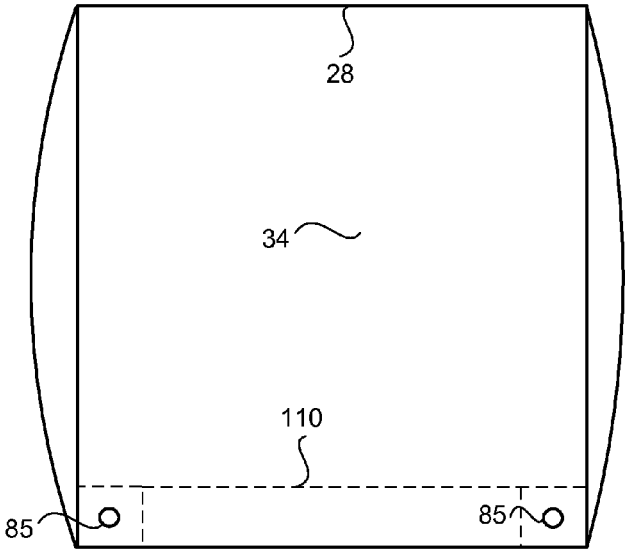

FIG. 10 is a top perspective view of a pillow case with layered and securable spare flaps folded around the pillow in accordance with an embodiment of the present disclosure.

Figure 11A:
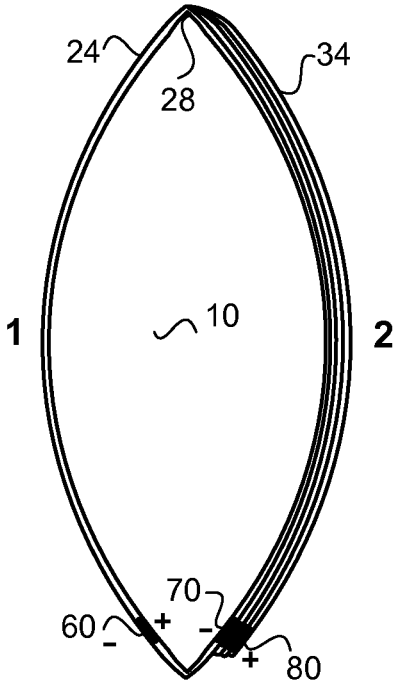

FIG. 11*a* is a side elevational view of a pillow case with layered and securable spare flaps exposing fresh sides 1 and 2 in accordance with an embodiment of the present disclosure.

Figure 11B:
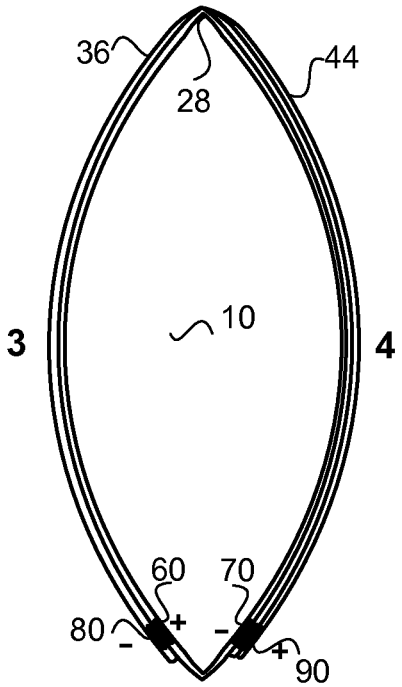

FIG. 11*b* is a side elevational view of a pillow case with layered and securable spare flaps exposing fresh sides 3 and 4 in accordance with an embodiment of the present disclosure.

Figure 11C:
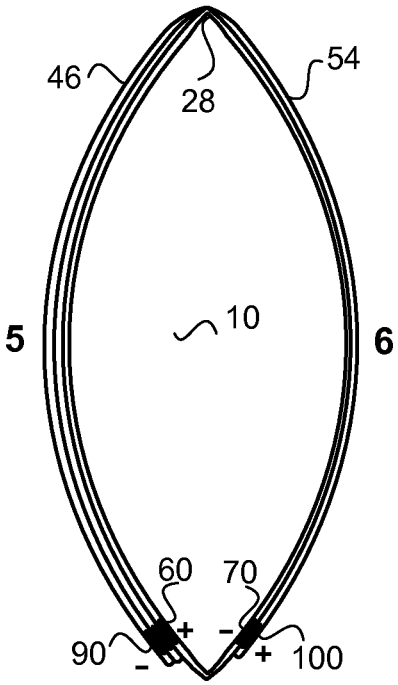

FIG. 11*c* is a side elevational view of a pillow case with layered and securable spare flaps exposing fresh sides 5 and 6 in accordance with an embodiment of the present disclosure.

Figure 11D:
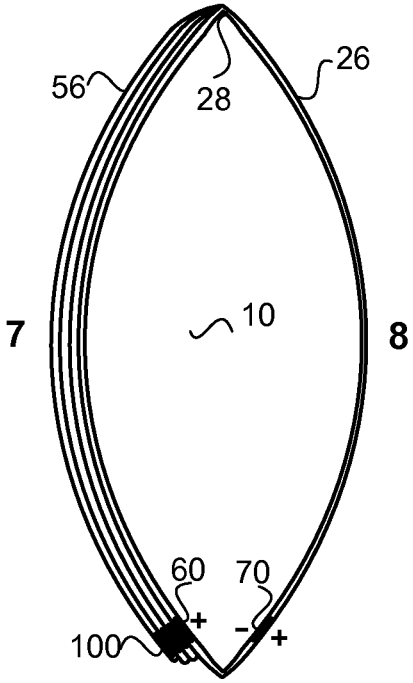

FIG. 11*d* is a side elevational view of a pillow case with layered and securable spare flaps exposing fresh sides 7 and 8 in accordance with an embodiment of the present disclosure.

Figure 12:
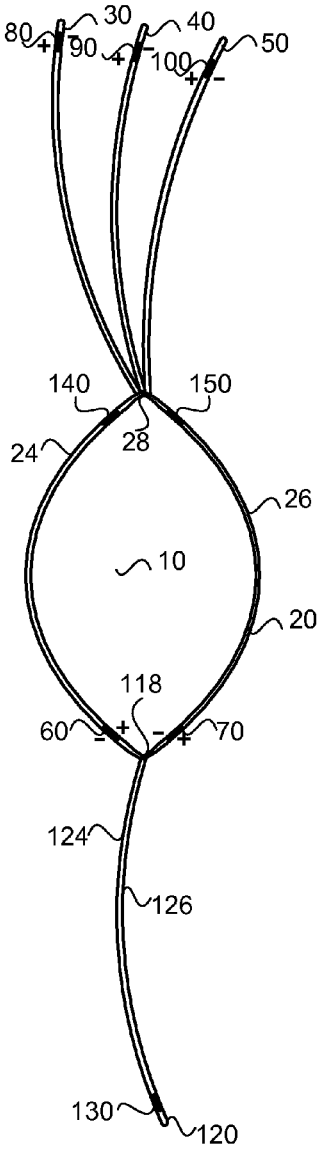

FIG. 12 is a side elevational view of a pillow case with layered and securable spare flaps including a protective flap extending from the pillow case in accordance with an embodiment of the present disclosure.

Figure 13:
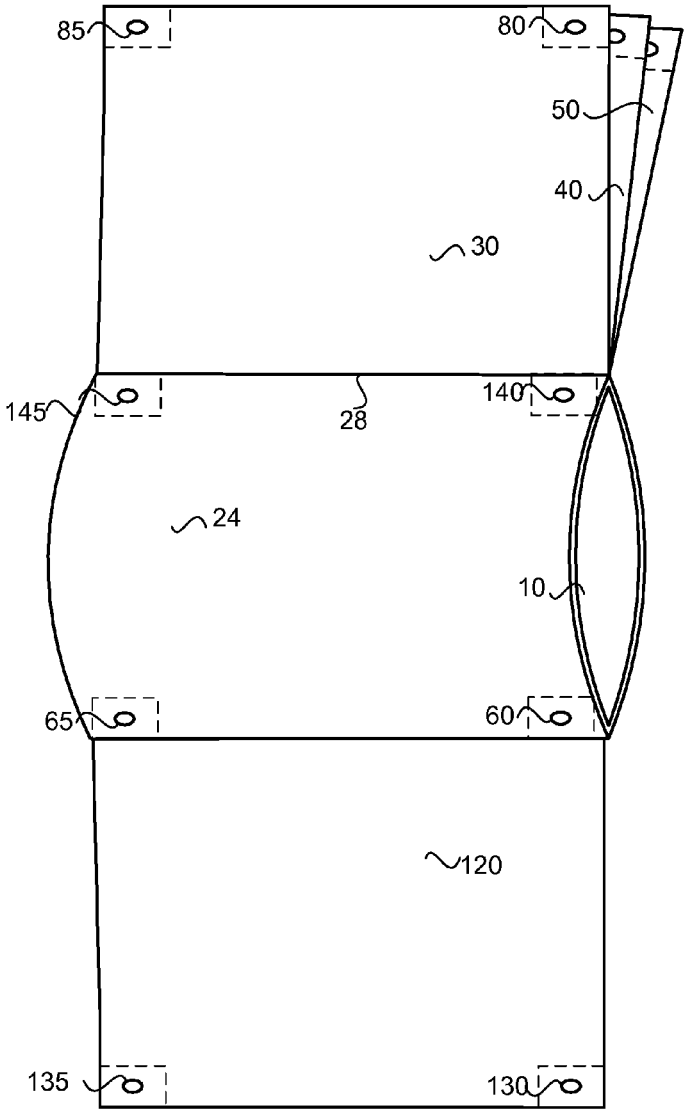

FIG. 13 is a top perspective view of a pillow case with layered and securable spare flaps including a protective flap extending from the pillow case in accordance with an embodiment of the present disclosure.

Figure 14A:
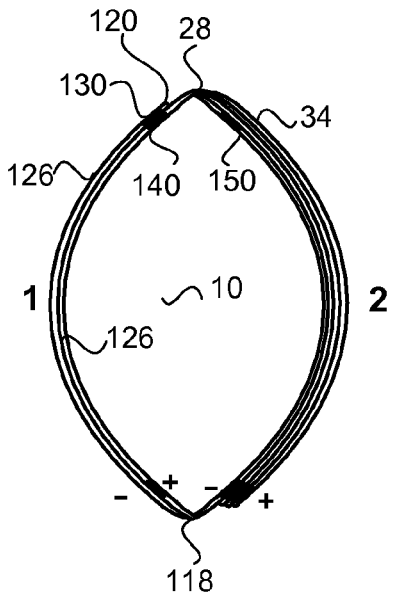

FIG. 14*a* is a side elevational view of the protective flap wrapped around a front side of the pillow case in accordance with an embodiment of the present disclosure.

Figure 14B:
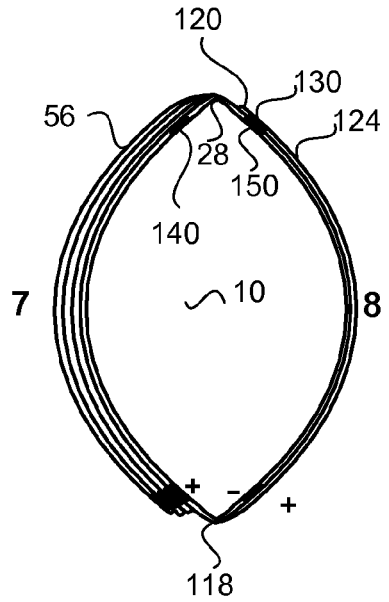

FIG. 14*b* is a side elevational view of the protective flap wrapped around the back side of the pillow case in accordance with an embodiment of the present disclosure.

Figure 15A:
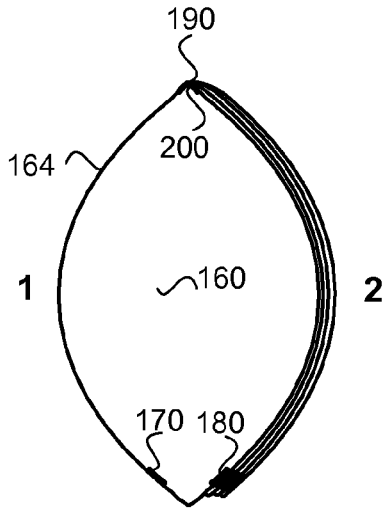

FIG. 15*a* is a side elevational view of a head rest with layered and securable spare flaps in accordance with an embodiment of the present disclosure.

Figure 15B:
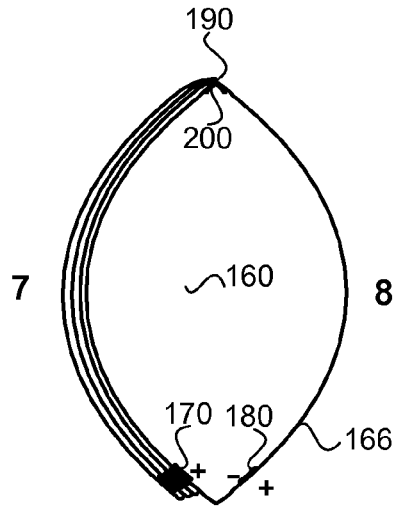

FIG. 15*b* is a side elevational view of a head rest with layered and securable spare flaps in accordance with an embodiment of the present disclosure.

Throughout the description, similar reference numbers may be used to identify similar elements in the several embodiments and drawings. However, the utility of similar elements having similar reference numbers in the various embodiments of the disclosure are not to be restricted to one embodiment or another as depicted and detailed herein.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

An embodiment of the disclosure utilizes different sheets of material or "flaps" attached to a pillow case which may be flipped, folded or wrapped around a pillow in a pillowcase and are securable to the pillowcase as well as to each other. The flaps are securable with magnets, hook and loop, snaps, buttons, etc. Magnets stack together as fasteners and may be contained within the fabric out of sight. Magnets may be randomly placed anywhere along a seam edge of a pillow case such as in the corners of the long edge of the case and flaps. This allows the flaps to be moved from one side of the pillow to the other, presenting two fresh sleeping surfaces per flap and two on the pillow case itself. Three flaps therefore provide a total of 8 fresh resting or sleeping surfaces. The flaps may consist of one or multiple pieces of fabric or other low durometer material.

As used throughout the present disclosure, the term 'rest support' is inclusive of pillows, cushions, head rests, arm rests, mattresses and other typically to padded supports for resting a body and/or appendages thereof. The term 'rest' may therefore apply not only to resting but also to 'placing' and 'setting,' and to 'sleeping' of a person or an animal and otherwise a pet on rest supports such as animal bedding and pet pillows etc. Additionally, the term 'user' may include a person, an animal and a person's pet. Furthermore, the term 'fold' and 'wrap' are synonymously used to indicate closely placing a flap around a portion or side of a rest support or rest support cover.

Figure 1:
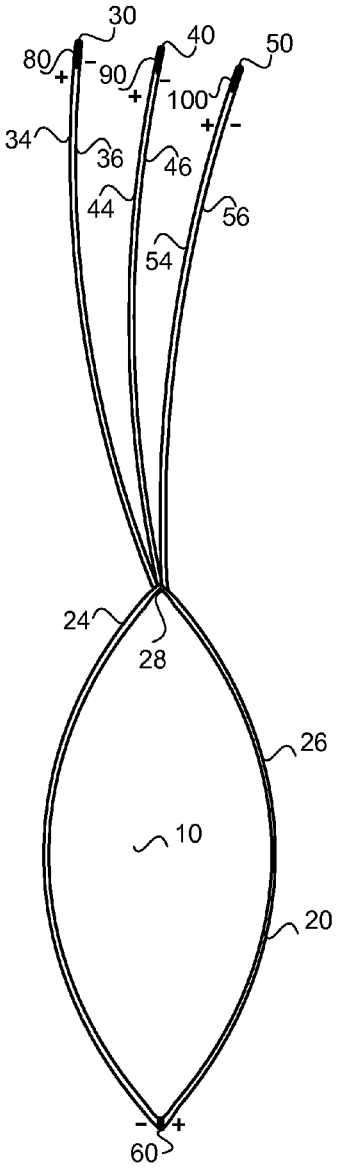
FIG. 1 is a side elevational view of a pillow case with layered and magnetically securable spare flaps extending from the pillow in accordance with an embodiment of the present disclosure.

FIG. 1 is a side elevational view of a pillow case with layered and magnetically securable spare flaps extending from the pillow in accordance with an embodiment of the present disclosure. A pillow 10 typically supports a person's head during rest or sleep and a pillow case 20 is therefore a rest support cover. The pillow case 20 may enclose at least a portion of the pillow 10. A pillow case 20 with layered spare flaps 30, 40 and 50 as disclosed is configured to cover at least a portion of the pillow 10, the pillow case 20 having a top 24 and a bottom 26 sleeping surface and a seam 28 there between. The spare flaps 30, 40 and 50 are attached in respective layers onto an outside of the pillow case 20 at the seam 28 thereof, each flap configured to successively fold around the pillow case 20 and provide an additional sleeping surface. At least one fastener is disposed at a flap free end distally positioned from the attached end, the fastener configured to secure the flap free end to at least one of the pillow case and another flap. Magnets are used as fasteners and rare earth magnets may allow thin magnets to be sewn into a flap or cover 20 with marginal increase in profile. A magnet 60 is disposed on or in the pillow case 20 to secure the flap 30 via the magnet 80 around the pillow case 20. Successive flaps 40 and 50 may also be secured to the pillow case 20 on top of the first flap 30. Alternatively, flaps 50 and 40 may be respectively secured to the pillow case adjacent the bottom 26 via the magnet 60 on or in the pillow case and respective magnets 100 and 90. Magnet polarity is noted on FIG. 1 to illustrate opposite polarity configurations which allow stacking the respective magnets in layered multiple flaps around the pillow case 20.

Figure 2:
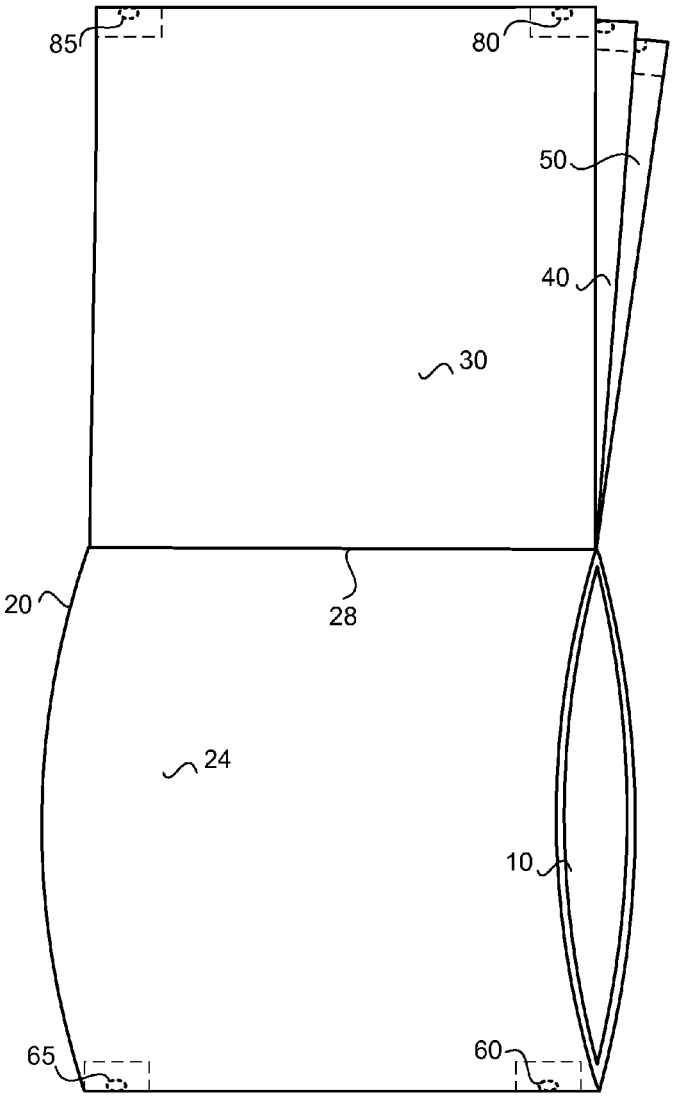
FIG. 2 is a top perspective view of a pillow case with layered and magnetically securable spare flaps extending from the pillow in accordance with an embodiment of the present disclosure.

FIG. 2 is a top perspective view of a pillow case with layered and magnetically securable spare flaps extending from the pillow in accordance with an embodiment of the present disclosure. The depiction includes the pillow 10, the pillow case 20, the flap 30, flap 40 and flap 50. Magnets 60 and 65 are disposed in to corners of the pillow case to fasten the flap 30 via the respective magnets 80 and 85. The magnets may be retained in the flaps and the cover via sewing lines depicted in broken lines enclosing each magnet. The seam 28 provides a hinge from which the flaps 30, 40 and 50 may wrap around a side of the pillow 10 and pillow case 20. Each of the flaps 30, 40 and 50 have a top side and a bottom side that may provide a fresh resting surface to a user. The top side of flap 30 is depicted as 34 and a bottom side (not depicted) as 36. The top side 34 becomes a resting or sleeping surface when wrapped around the bottom side 26 of the pillow case 20. The bottom side 36 becomes a resting or sleeping surface when wrapped around the top side 24 of the pillow case 20.

The flaps may be constructed of a single sheet of material or constructed of two sheets of material quilted or otherwise adjacent to each other. Flaps may take any shape necessary to cover at least a portion of a rest support including rectangular, square, triangular and circular, but may also comprise ornamental patterns. A flap may also comprise a material intermediate to a top sheet and a bottom sheet or otherwise integrally formed into a single sheet flap. The intermediate sheet may be water repellant, water proof or semipermeable in order to isolate one side of a flap from the other side of the flap.

In an embodiment of the disclosure, the rest support cover comprises a pillow case, a cushion cover, a headrest cover, an arm rest cover, a foot rest cover and a bedding cover and the like configurable for one of a person, an animal and a pet. Furthermore, a cushion cover may comprises a portable seat cushion cover, a built-in chair cushion cover, a restaurant seat cushion cover, a public transportation seat cushion cover, a medical seat cushion cover, a sports seat cushion cover, an amusement park seat cushion cover, a baby chair seat cushion cover, a nursing home seat cushion cover and the like. A headrest cover may comprise a pillow case, an airplane headrest cover, an automobile headrest cover, a public transit headrest cover, an amusement park headrest cover, a sports headrest cover, a medical headrest cover and the like.

Figure 3:
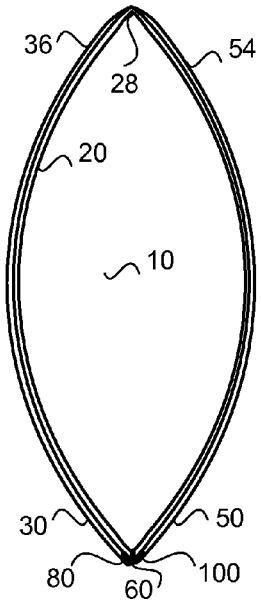
FIG. 3 is a side elevational view of a pillow case with layered and magnetically securable spare flaps folded around the pillow in accordance with an embodiment of the present disclosure.

FIG. 3 is a side elevational view of a pillow case with layered and magnetically securable spare flaps folded or wrapped around the pillow in accordance with an embodiment of the present disclosure. The elements and features detailed in FIG. 1 and FIG. 2 above are the same or similar in FIG. 3 as to depicted except there is no third flap 50 depicted. The first flap 30 is wrapped around the top side of the pillow case 24 and the magnet 80 is attached to the magnet 60. The bottom side 36 of flap 30 is therefore exposed. The second flap 40 is wrapped around the bottom side 26 of the pillow case 20 and the magnet 90 is also attached to the magnet 60. The top side 54 of flap 50 is therefore exposed. The flaps 30 and 50 are depicted contiguous at the tip of the pillow case but may be non-contiguous in embodiments of the disclosure.

In an embodiment of the disclosure, the pillow case is rectangular shaped and the seam thereof is a longitudinal seam. The flaps are sewn in respective layers to the pillow case at the seam thereof. The flaps nominally comprise three flaps configured to provide a total of 8 new sleeping surfaces with the pillow case. However, any number of flaps may be used in embodiments of the disclosure. Also, any number of layered groups of flaps may be used for rest supports having any number of resting surfaces.

Because the spare flaps are substantially similar in size and shape relative to each other to allow used sides to lay adjacent to and to cover each other and therefore also to allow fresh sides to lay adjacent to and to cover each other or to be exposed for use, contamination of a fresh side with a used side is avoided. Were the flaps configured of different sizes or shapes this may not be true. Furthermore, if the flaps were large enough to wrap completely around the pillow in one direction, a used side could then be adjacent a fresh side and therefore contaminate it against future use.

Each flap may also comprise at least one fastener disposed at a flap free end distally positioned from an end attached to the pillow case, the fastener configured to attach the flap free end to at least one of the pillow case and another flap. The pillow case with flaps may comprise at least one fastener, each fastener disposed at a corner of a flap and a complementary fastener disposed at a respective corner of the pillow case. The fastener may comprise a thin magnet, one of a hook and loop material, one of a grommet and tie pair, one of a button and a button hole, one of a female and male snap fastener and the like wherein a complementary fastener is disposed respectively on the pillow case.

Figure 4:
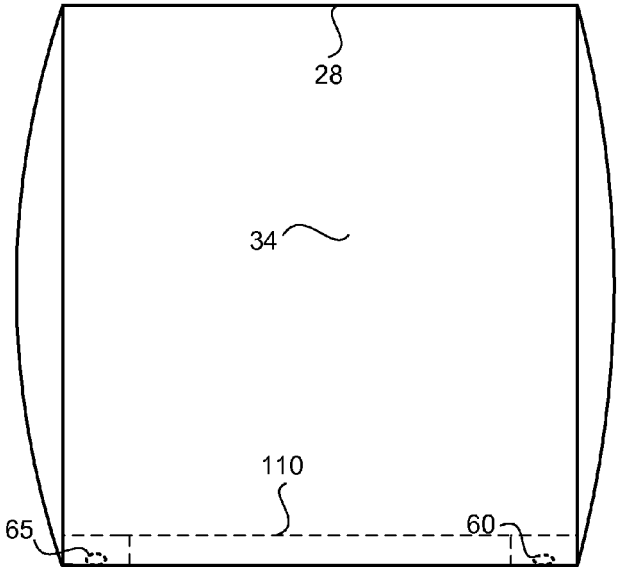
FIG. 4 is a top perspective view of a pillow case with layered and magnetically securable spare flaps folded around the pillow in accordance with an embodiment of the present disclosure.

FIG. 4 is a top perspective view of a pillow case with layered and magnetically securable spare flaps folded around the pillow in accordance with to an embodiment of the present disclosure. The depiction shows the free end of flap 30 secured to the pillow case via magnets 80 and 85 fastened by electromagnetic fields to the pillow case magnets 60 and 65 respectively. Therefore, the bottom side 36 of flap 30 is exposed as a resting surface and the top side 36 (not depicted) is adjacent the top side 24 of the pillow case 20. Because the flap 30 is substantially the same size and shape as the top of the pillowcase, the flap 30 in addition to providing a fresh resting surface, also covers the top side 24 of the pillow case 20 in the event it is used and otherwise soiled or contaminated. Flap 40 is similarly fastened to the bottom side 26 of the pillow case via the magnets 60 and 65 (not depicted) and complementary magnets disposed in the corners of flap 40. The topside 44 of flap 40 is likewise exposed as a sleeping or resting surface because flap 40 is folded or wrapped around the pillow 10 in the pillowcase 20. Again, because the bottom side 46 of flap 40 is adjacent the bottom of the pillow case 26, it may act as a cover of the pillow case bottom side 26 in the event it has already been used for resting or sleeping.

A further embodiment of the disclosure may comprise a fastener disposed in a specific location in a flap via one of a hem, a low durometer spacer 110 and adhesive and thread-like materials. The spacer 110 is configured to retain at least two fasteners in a respective position relative to each other. The spacer or separator 110 may be sewn into each flap and a rest support cover such as a pillow case 20 and hold the magnets at the corners of a flap a predetermined distance from each other. Since the spacer may be sewn into a flap or a cover, it is therefore depicted in broken lines. The spacer 110 may be made of a flexible material that would not be harmed by washing or drying (silicone, or plastic for example.) The spacer 110 may make it easier to disconnect and reconnect the flaps from each other and allow a user to grab the middle of the edge of the flap and rotate it to its desired position. The magnets in the cover and in the flaps would then attract each other at the corners and the process of providing a fresh resting surface would be complete. The spacer 110 may remove the hassle associated with lining up the magnets with the two corners individually. This spacer 110 could either be separate from the magnets or the magnets could be incorporated into the spacer in embodiments of the disclosure.

Figure 5:
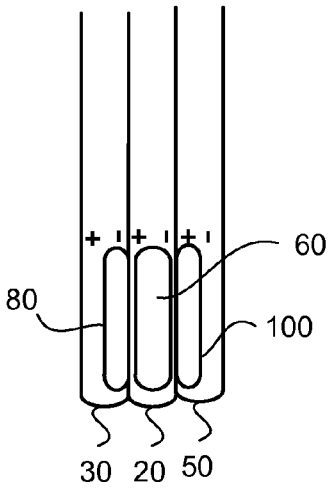
FIG. 5 is a side elevational view of a magnetic fastener for securing multiple spare flaps to a pillow case in accordance with an embodiment of the present disclosure.

FIG. 5 is a side elevational view of a magnetic fastener for securing to multiple spare flaps to a pillow case in accordance with an embodiment of the present disclosure. A respective thin magnet fastener 60, 80 and 100 may be comprised in each flap or cover 20, 30 and 50 respectively at an identical geometrical point and magnetically oriented to form a stack of magnets in successive flap layers. Also, hook and loop materials may analogously be used where a hook material may be represented by a positive magnetic terminal and the complementary loop material may be represented by the negative magnetic terminal and therefore be ganged together for fastening all the flaps in a layered fashion to the pillow case. Fasteners of various types as disclosed are therefore interchangeable in the figures herein and in multiple embodiments of the disclosure.

Figure 6A:
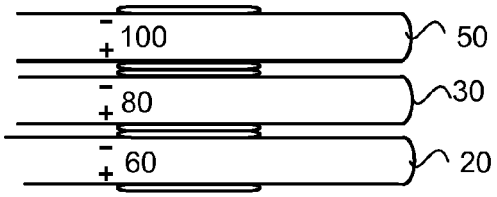

FIG. 6*a* is a side elevational view of a mechanical fastener for securing multiple spare flaps to a pillow case in accordance with an embodiment of the present disclosure. Mechanical fasteners may comprise hook and loop materials and otherwise semi-permanent adhesive surfaces. Hook and loop surfaces are arbitrarily depicted with a '+' sign for a hook material and a '−' sign for a loop material. Therefore, a hook and loop fastener 60, 80 and 100 may be comprised on each flap or cover 20, 30 and 50 respectively at an identical geometrical points and mechanically oriented to form a stack of fasteners in successive flap layers.

Figure 6B:
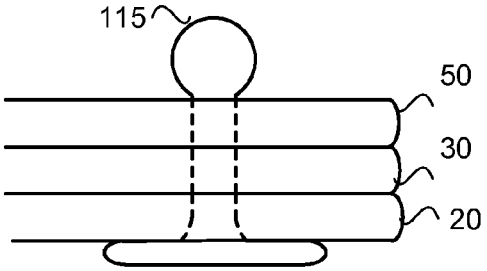

FIG. 6*b* is a side elevational view of a post and ganged hole mechanical fastener for securing multiple spare flaps to a pillow case in accordance with an embodiment of the present disclosure. The phrase, "post and ganged hole fastener' refers to a post or barbell type male end which may be inserted through multiple or ganged female button-like holes of several layers of fabric or flaps for fastening the flaps to a single male fastener on a cover. The post 115 may be made of soft silicon able to withstand the laundry process and retain its shape and low durometer properties. The three layered flaps 30, 40 and 50 fastened thereto have button holes therein which allow the flap to slip over the post 115 and become fastened or secured thereto. Other fastener types may similarly be used to secure the flaps to each other and to the pillow case.

FIG. 7 is a side elevational view of a pillow case with layered and securable spare flaps extending from the pillow in accordance with an to embodiment of the present disclosure. The flaps may be fastened with any of the disclosed magnetic and/or mechanical fasteners and the like. A pillow case 20 may enclose at least a portion of the pillow 10. A pillow case 20 with layered spare flaps 30, 40 and 50 as disclosed is configured to cover at least a portion of the pillow 10. At least one fastener is disposed at a flap free end distally positioned from the attached end, the fastener configured to secure the flap free end to at least one of the pillow case and another flap. A fastener 60 is disposed on or in the pillow case 20 to secure the flap 30 via the fastener 80 around the pillow case 20. Successive flaps 40 and 50 may also be secured to the pillow case 20 on top of the first flap 30. Alternatively, flaps 50 and 40 may be respectively secured to the pillow case adjacent the bottom 26 via the fastener 70 on or in the pillow case and respective fasteners 100 and 90.

FIG. 8 is a top perspective view of a pillow case with layered and securable spare flaps extending from the pillow in accordance with an embodiment of the present disclosure. Again, the flaps may be fastened with any of the disclosed magnetic and/or mechanical fasteners and the like. The depiction includes the pillow 10, the pillow case 20, the flap 30, the flap 40 and the flap 50. Fasteners 60 and 65 are disposed in corners of the pillow case to fasten the flap 30 via the respective fasteners 80 and 85. The fasteners may be retained in the flaps or on the flaps and the cover via sewing lines depicted in broken lines enclosing each fastener. The seam 28 provides a hinge from which the flaps 30, 40 and 50 may wrap around a side of the pillow 10 and pillow case 20. Each of the flaps 30, 40 and 50 have a top side and a bottom side that may provide a fresh resting surface to a user. The top side of flap 30 is depicted as 34 and a bottom side (not depicted) as 36. The top side 34 becomes a resting or sleeping surface when wrapped around the bottom side 26 of the pillow case 20. The bottom side 36 becomes a resting or sleeping surface when wrapped around the top side 24 of the pillow case 20.

FIG. 9 is a side elevational view of a pillow case with layered and securable spare flaps folded or wrapped around the pillow in accordance with an embodiment of the present disclosure. The elements and features detailed in FIG. 7 and FIG. 8 above are the same or similar in FIG. 9 as depicted except there is no third flap 50 depicted. The first flap 30 is wrapped around the top side of the to pillow case 24 and the fastener 80 is attached to fastener 60. The bottom side 36 of flap 30 is therefore exposed. The second flap 40 is wrapped around the bottom side 26 of the pillow case 20 and fastener 90 is attached to fastener 70. The top side 54 of flap 50 is therefore exposed. The flaps 30 and 50 are depicted non-contiguous at the tip of the pillow case but may be contiguous in embodiments of the disclosure.

FIG. 10 is a top perspective view of a pillow case with layered and securable spare flaps folded around the pillow in accordance with an embodiment of the present disclosure. The depiction shows the free end of flap 30 secured to the pillow case via fasteners 80 and 85 fastened to the pillow case fasteners 60 and 65 respectively. Therefore, the bottom side 36 of flap 30 is exposed as a resting surface and the top side 36 (not depicted) is adjacent the top side 24 of the pillow case 20. Because the flap 30 is substantially the same size and shape as the top of the pillowcase, the flap 30 in addition to providing a fresh resting surface, also covers the top side 24 of the pillow case 20 in the event it is used and otherwise soiled or contaminated. Flap 40 is similarly fastened to the bottom side 26 of the pillow case via fasteners 70 and 75 (not depicted) and complementary fasteners disposed in the corners of flap 40. The topside 44 of flap 40 is likewise exposed as a sleeping or resting surface because flap 40 is folded or wrapped around the pillow 10 in the pillowcase 20. Again, because the bottom side 46 of flap 40 is adjacent the bottom of the pillow case 26, it may act as a cover of the pillow case bottom side 26 in the event it has already been used for resting or sleeping.

FIG. 11*a* is a side elevational view of a pillow case with layered and securable flaps exposing fresh sides 1 and 2 in accordance with an embodiment of the present disclosure. Side 1 is the top side 24 of the pillow case 20 exposed as a resting or sleeping surface when all three flaps are wrapped around and secured to the bottom side 26 of the pillow case via fasteners 80, 90 and 100 respectively to fastener 60 and fasteners 85, 95 and 105 (not depicted) respectively fastened to fastener 65. Side 2 is the top side 34 of the first flap 30. The flaps 30, 40 and 50 may be secured to the pillow case via a post fastener as discussed above disposed on the pillow case and buttonhole like openings in the flaps. At this point all the to resting surfaces are fresh, clean and ready for use.

An embodiment of the pillow case or rest support cover may comprise flaps of a plurality of scents, colors, shapes, textures and other characteristics configured to provide a variable sleeping surface to a user thereof. Variable sleeping surfaces may be required for medical or any number of other reasons but may also simply provide user options for changes in weather etc. For instance, in warmer weather a user may desire a silk-like flap and in cooler weather may desire a felt-like flap. The flaps may therefore comprise a quilted fabric, a bedding material comprising cotton, polyester, a cotton-polyester blend, silk, a medicinal gauze and any other fabric and material configured to provide a sleeping surface, a medicinal surface and resting surface for a user thereof.

FIG. 11*b* is a side elevational view of a pillow case with layered and securable flaps exposing fresh sides 3 and 4 in accordance with an embodiment of the present disclosure. At this point, the first and second sides have been used and therefore may be soiled and otherwise contaminated. The first flap 30 is wrapped around the top side 24 of the pillow case 20 and fastener 80 is fastened to the fastener 60. Therefore the bottom side 36 of the flap 30 is exposed as the third resting or sleeping surface and the two used sides 1 and 2 are now adjacent to each other and are mutually covered. The second flap 40 and the third flap 50 are wrapped around the bottom side of the pillow case 26 and secured to fastener 70 via the respective fasteners 90 and 100. The top side 44 of flap 40 is therefore exposed as the fresh resting or sleeping side 4 and the bottom side 36 of flap 30 is exposed as the fresh resting or sleeping side 3.

FIG. 11*c* is a side elevational view of a pillow case with layered and securable flaps exposing fresh sides 5 and 6 in accordance with an embodiment of the present disclosure. The first and second flaps 30 and 40 are wrapped or folded around the pillow 10 in the pillow case 20 and secured to fastener 60 via respective fasteners 80 and 90. Therefore the bottom side 46 of flap 40 is exposed as the resting or sleeping surface 5 and the top side 54 of flap 50 is exposed as the resting or sleeping side 6. Note that sides 3 and 4 which were used prior to exposing fresh sides 5 and 6, are now adjacent each other and therefore cover each other from exposure to the user or the bed linens, or couch or the like.

FIG. 11*d* is a side elevational view of a pillow case with layered and securable flaps exposing fresh sides 7 and 8 in accordance with an embodiment of the present disclosure. Flap 50 is wrapped or folded around the pillow 10 in the pillow case 20 via securing fastener 100 to fastener 90 which in turn is secured to fastener 80 which is secured to fastener 60 on the pillow case 20. Therefore the bottom side of flap 50 is exposed as resting or sleeping surface 7 and the bottom side 26 of the pillow case 20 is exposed as the sleeping surface 8.

Indicia embroidered or otherwise disposed on the flaps may therefore correspond to the resting or sleeping surfaces explained above. Indicia may also correspond to days of the week such as 1 for Sunday, 2 for Monday and so forth with 8 unused or unassigned for users doing laundry on a weekly schedule. The indicia may therefore help a user keep track of the successive use of multiple flaps and avoid using a contaminated flap more than once.

FIG. 12 is a side elevational view of a pillow case with layered and securable spare flaps including a protective flap extending from the pillow case in accordance with an embodiment of the present disclosure. The elements and features detailed above in FIG. 1 and FIG. 2 are the same or similar in FIG. 12 as depicted with the exception of the protective flap 120, the magnets 130 and 135 and respective magnets in the pillow case 140, 145 and 150 and 155 (undepicted) which may secure the protective flap 120. The protective flap 120 also has a top side 124 and a bottom side 126 and may be attached to the pillow case 20 at a second longitudinal seam 118.

FIG. 13 is a top perspective view of a pillow case with layered and securable spare flaps including a protective flap extending from the pillow case in accordance with an embodiment of the present disclosure. The protective flap 120 may be sewn into the pillow case at an opposing long seam 118 thereof, the protective flap 120 configured to fold around the flaps 30, 40 and 50 secured to the pillow case 20 in order to protect the bedding or other supports from a used and otherwise contaminated flap. With reference to FIG. 6*a*, after the first fresh surface has been used and the user flips the pillow to use fresh surface 2, the first surface may be in contact with the bedding and may therefore contaminate the bedding. The protective flap 120 may therefore be secured around the bottom of the first surface and prevent the contamination of the bedding.

An embodiment of the disclosure may comprise indicia on or in each flap indicating at least one of an order of use and a time of use of the flap respective to the other layered flaps. The indicia may be disposed on a flap via one of embroidery, an embossing, a print, a marking and the like. Use indicia therefore assist a user in keeping track of which resting surfaces have been used and which are still fresh.

FIG. 14*a* is a side elevational view of a pillow case with layered and securable spare flaps wrapped around a pillow and the protective flap wrapped around a front side of the pillow case. The elements and features detailed in FIG. 12 and FIG. 13 above are the same or similar as depicted here. The protective flap 120 may be wrapped around resting surface 1 or the top side 24 of the pillow case in the event surface 1 has been used. Fresh surface 2 may therefore be placed upward for subsequent use without used surface 1 contaminating the bedding underneath. The protective flap is depicted wrapped around the top side 24 of the pillow case and therefore exposing the bottom side 126 of the protective flap 120. The protective flap is secured to the pillow case via the magnets 130, 140 and 135 and 145 (undepicted). However, the protective flap 120 may also be wrapped around any of the other flaps layered around the pillow case 20. Similar to FIG. 6*b* and FIG. 6*c*, fresh resting surfaces 3, 4, 5 and 6 may therefore be exposed for the user of the headrest 160 by successively wrapping and securing the flaps around the headrest 160.

The protective flap may comprise a semipermeable inner membrane configured to allow perspirants to pass but block bodily fluids from passage from one side of the flap to the other side of the flap and therefore isolate a fresh surface from a used and otherwise contaminated surface of the flap.

FIG. 14*b* is a side elevational view of a pillow case with layered and securable flaps wrapped around a pillow and the protective flap wrapped around a back side of the pillow case. The elements and features detailed in FIG. 6 above are the same or similar as depicted here. The protective flap 120 may be secured to the pillow case via magnets 130 and 150 and 135 and 155 (undepicted). Therefore, the bottom side 126 of the protective flap is adjacent the resting surface 8 and shields it from contaminating the bedding underneath when fresh rest to surface 7 (bottom side 56 of flap 50) is presented upwards for a user. Thus the uncontaminated bottom side 124 of the protective flap 120 may be adjacent the bedding.

The top side 124 of the protective flap 120 may lie against sides 1, 3, 5 and 7 and thus each time present uncontaminated side 126 to the bedding. Alternatively, the bottom side 126 of the protective flap 120 may lie against sides 2, 4, 6 and 8 and thus each time present uncontaminated side 124 to the bedding. Care should be taken though to not use both sides 124 and 126 against used flaps or the protective flap 120 itself will be compromised and will no longer have an uncontaminated side to present to the bedding. One of the primary flaps 30, 40 and 50 may also be used as a protective flap but attached at seam 28 rather than seam 128 may limit which flaps it may protect against contamination to the bedding.

FIG. 15*a* is a side elevational view of a head rest with layered and securable spare flaps in accordance with an embodiment of the present disclosure. The elements and features detailed in FIG. 6 above are the same or similar as depicted here. The spare flaps depicted are configured to cover a portion of a headrest 160 and secure thereto via magnets 180 and 185 (undepicted) which may be disposed on or in the headrest after original equipment manufacture of the headrest 160. The spare flaps may be attached in respective layers to the headrest 160 at an end of each flap to the seam or edge 190 of the headrest 160. Each flap is configured to successively fold around the headrest and provide at least one additional unused and fresh resting surface.

Therefore, at least one of the spare flaps are attached to the headrest via a magnet 200 or an adhesive, a sewed seam, a perforation, a zipper, a hook and loop complementary pair and the like. The magnet 200 may be an elongated magnet or may comprise several magnets disposed along an upper seam or edge of the headrest 160 depending on the shape of the headrest 160. A top side of the headrest 164 presents surface 1 and a topside of a third flap presents fresh surface 2. Similar to FIG. 6*b* and FIG. 6*c*, fresh resting surfaces 3, 4, 5 and 6 may therefore be exposed for the user of the headrest 160 by successively wrapping and securing the flaps around the headrest 160.

FIG. 15*b* is a side elevational view of a head rest with layered and securable spare flaps in accordance with an embodiment of the present disclosure. The elements and features detailed in FIG. 6 above are the same or similar as depicted here. Headrest 160 bottom surface 166 is depicted as surface 8 and the spare flaps are secured to the front side 164 of the headrest 160 via the magnets 170 and 175 (undepicted). As explained above in FIG. 10*a*, the spare flaps are attached in respective layers to the headrest 160 at an end of each flap to the seam or edge 190 of the headrest 160.

In an embodiment of the disclosure, a zipper (not depicted) may be configured to detachably affix a flap to the headrest 160 at the seam or edge 190 to allow a user to detach a flap for laundering and reattach the flap to the headrest 160 for subsequent usage. Also, a flap may comprise a perforation along the attached end and be configured to disposably detach therefrom after usage and therefore preclude laundering the flap. Disposable flaps may therefore comprise cloth, high fiber content paper, paper-cloth composites, recyclable materials and the like.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents.

What is claimed is:

1. A rest support cover, comprising:

a rest support cover configured to enclose at least a portion of a rest support, the rest support cover being removable from the rest support, the cover having a top and a bottom and a seam there between and at least one resting surface thereon; and a plurality of spare flaps attached in respective layers onto an outside of the cover at the seam thereof, each flap configured to successively fold around the rest support cover and provide an additional two resting surfaces; and a magnet fastener located in each of the plurality of spare flaps at an identical geometrical point and magnetically oriented to form a stack of magnets in successive spare flap layers.

2. The rest support cover of claim 1, wherein the plurality of spare flaps are substantially similar in size and shape and are configured relative to each other to allow used sides to lay adjacent to each other and to cover each other and therefore also to allow fresh sides to lay adjacent to and to cover each other or to be exposed for use and therefore avoid the contamination of a fresh side with a used side.

3. The rest support cover of claim 1, wherein the plurality of spare flaps nominally comprise three flaps configured to provide a total of 8 new resting surfaces with the cover.

4. The rest support cover of claim 1, wherein at least one of the plurality of spare flaps comprises a semipermeable inner membrane configured to allow perspirants to pass but block bodily fluids from passage from one side of the at least one spare flap to the other side and therefore isolate a fresh surface from a used and otherwise contaminated surface of at least one spare flap.

5. The rest support cover of claim 1, further comprising an additional protective flap sewn into the pillow case at an opposing seam thereof, the protective flap configured to fold around the plurality of spare flaps in order to protect the rest support from a used and otherwise contaminated plurality of spare flaps.

6. The rest support cover of claim 1, wherein the at least one magnet fastener(s) are disposed at a free corner of the plurality of spare flaps and a complementary magnet fastener disposed at a respective corner of the cover via a spacer, the spacer configured to retain at least two magnet fasteners a predetermined distance from each other.

7. The rest support cover of claim 1, wherein the plurality of spare flaps comprise a plurality of scents, colors, shapes, textures and other characteristics configured to provide a variable resting surface to a user thereof.

8. The rest support cover of claim 1, wherein at least one of the plurality of spare flaps comprises a quilted fabric, a bedding material comprising cotton, polyester, a cotton-polyester blend, silk, a medicinal gauze and any other fabric and material configured to provide a sleeping surface, a medicinal surface and resting surface for a user thereof.

9. The rest support cover of claim 1, wherein the plurality of spare flaps comprises an indicia indicating at least one of an order of successive use and a time of use of the plurality of spare flap respective to the other layered plurality of spare flaps, the indicia disposed on at least one of the plurality of spare flaps via one of an embroidery, an embossing, a print, a marking and the like.

10. A reusable pillow case, comprising:

a plurality of spare flaps attached in respective layers to an outside of a pillow case at an attached end of each flap, a free end of the plurality of spare flaps configured to successively fold around the pillow case and provide an additional usable surface; and at least one magnet fastener disposed at the free end distally positioned from the attached end, the fastener configured to secure the free end to at least one of the pillow case and another of the plurality of spare flaps;

wherein the plurality of spare flaps are coupled to the reusable pillow case along the attached end and configured to repeatedly alternate between sides of the reusable pillow case for use a plurality of times.

* * * * *